US007302222B2

(12) United States Patent
Ho et al.

(10) Patent No.: US 7,302,222 B2
(45) Date of Patent: Nov. 27, 2007

(54) AUTOMATIC DOCUMENT FEEDER (ADF) WITH A RELEASING DEVICE

(75) Inventors: Yung-Shun Ho, NanTou Hsien (TW); Tsung-Te Lin, Taipei (TW)

(73) Assignee: BenQ Corporation, Taoyuan (TW)

( * ) Notice: Subject to any disclaimer, the term of this patent is extended or adjusted under 35 U.S.C. 154(b) by 392 days.

(21) Appl. No.: 11/076,692

(22) Filed: Mar. 10, 2005

(65) Prior Publication Data

US 2005/0207809 A1 Sep. 22, 2005

(30) Foreign Application Priority Data

Mar. 19, 2004 (TW) ..... 93107519 A

(51) Int. Cl.
*G03G 15/00* (2006.01)
*B65H 5/00* (2006.01)

(52) U.S. Cl. ..... 399/367; 399/16; 399/21; 271/3.14

(58) Field of Classification Search ..... None
See application file for complete search history.

(56) References Cited

U.S. PATENT DOCUMENTS 5,842,692 A * 12/1998 Rutishauser ..... 271/3.2
7,212,320 B2 * 5/2007 Imoto ..... 358/497

FOREIGN PATENT DOCUMENTS

JP 2000211763 A * 8/2000
JP 2006096424 A * 4/2006

* cited by examiner

*Primary Examiner*—Daniel J. Colilla
*Assistant Examiner*—N. Ha
(74) *Attorney, Agent, or Firm*—Ladas and Parry LLP

(57) ABSTRACT

An automatic document feeder (ADF) with a feeding roller used to carry a paper sheet to a reading position is provided. The ADF comprises a feeding path, a paper cartridge, an exit roller set, and a first lever. The feeding path is arranged in the ADF for guiding the paper sheet reaching the reading position and leaving the reading position. The paper cartridge has a fixed front edge aligned with an inlet of the feeding path. The exit roller set is located by the feeding path and at a downstream position with respect to the reading position. The exit roller set includes two exit rollers leaning against each other for carrying the paper sheet leaving the ADF. The first lever is connected between the paper cartridge and one of the exit rollers. As the paper sheet is jammed at the exit roller set, the paper cartridge may be raised to drive the first lever to separate the two exit rollers for removing the jammed paper sheet.

9 Claims, 10 Drawing Sheets

AUTOMATIC DOCUMENT FEEDER (ADF) WITH A RELEASING DEVICE

BACKGROUND OF THE INVENTION (1) Field of the Invention

The invention relates to an automatic document feeder (ADF), and more particularly to the ADF with a releasing device for removing jammed papers to recover its normal operation.

(2) Description of the Prior Art

In the 90's, a scanner was a rather expensive computer peripheral device. For its complex operating procedure, the scanner was mainly used by professional digital image operation users. However, with an well development of the imaging technologies in the recent years, lots of low-cost and user friendly scanners have been crowded into the market and the scanners have become an indispensable part for personal users or small-sized offices.

Scanners at present are classified into feeder type and flatbed type. The flatbed type scanner has a similar design with respect to a small-sized copier by placing papers, books, or other documents to be scanned on a glass plate. Characterized with small size and low cost, the flatbed type scanner is more popular among self-employers. In addition, with the progress of scanning technologies, the scanning of three-dimensional objects has become feasible for the flatbed-type scanners.

In contrast with the flatbed-type scanners, feeder-type scanners are mainly used to satisfy the demand in large amount documents circumstance. A major advantage of feeder-type scanners is the so-called multi-page continuously scanning function, which leads to a relatively high scanning speed. However, also characterized by the multi-page scanning design, feeder-type scanners cannot scan stapled documents, photographs, or three-dimensional objects.

In order to increase the scanning speed of the flatbed-type scanners, an automatic document feeder (ADF) is reinvented to assemble on the flatbed-type scanner for proceeding multi-page continuously scanning to meet the need of large amount paper sheets. FIG. 1A shows a cross section view of a traditional ADF 100 with a feeding path 110 arranged therein. FIG. 1B is an enlarged view depicting the portion shown in FIG. 1A encircled by central line and indicating the feeding path 110 by the arrow. As shown, the traditional ADF 100 has a feeding path 110, a paper cartridge 120, a feeding roller 130, a relay roller set 140, and an exit roller set 150. The front edge 120*a* of the cartridge is aligned with the inlet 110*a* of the feeding path 110. The feeding roller 130 is located by the inlet 110*a* to carry a paper sheet along the feeding path 110 to a reading position 160 to be scanned, copied, or the like. The relay roller set 140, which is located in the middle of the feeding path 110, includes an active roller 142 and an idle roller 144 leaning against each other. The active roller 142 and the idle roller 144 are located on the opposite sides of the feeding path 110 respectively to clip and feed the paper sheet to the reading position 160. The exit roller set 150, which is located by the outlet 110*b* of the feeding path 110, includes an active roller 152 and an idle roller 154 located on the opposite sides of the feeding path 110 and leaning against each other for carrying the scanned paper sheet away from the reading position 160.

It is noted that the paper sheet inside the ADF is transmitted by the friction force from the rollers. A too much friction force may damage the paper sheet or even induce paper jam. That is, as shown in FIG. 1B, along the feeding path 110, the positions near the relay roller set 140 and the exit roller set 150 are most likely to have paper jam occurred because the friction force reaches a maximum.

When paper jam occurs, quickly removal of the jammed paper sheet is required for recovering the normal operation of the ADF. FIG. 2 shows a typical method for removing the jammed paper sheet in the traditional ADF 100 of FIG. 1. If the paper sheet is jammed in the exit roller set 150, the user has to pull the jammed paper sheet through the outlet 110*b* of the feeding path 110 along the direction shown by arrow to recover the normal operation of the ADF 100. If the paper sheet is jammed in the relay roller set 140, the user has to open a cover 170 to expose the relay roller set 140 and then pull the jammed paper sheet upward along the direction shown by the arrow to recover the normal operation of the ADF 100.

Both the foregoing situations of removing jammed paper sheet involve applying force to pull the jammed paper sheet from the leaned rollers, thus, the following problems may occur.

Firstly, when pulling the jammed paper sheet out the ADF, some damage or even tearing event on the paper sheet is unavoidable. If there is no backup or the document is highly important, such removal method may probably lead to an unrecoverable mistake.

Secondly, improper pulling force applied on the ADF may probably damage the ADF and shorten the expecting life of the ADF.

Thirdly, as a paper sheet of highly important is severely jammed in the ADF, the only way is to send the ADF back to the dealer for repairing and removing the jammed paper sheet. Obviously, this may lead to a considerable maintenance expense and a significant time cost.

SUMMARY OF THE INVENTION

Accordingly, an automatic document feeder (ADF) provided in the present invention focuses on solving the above mentioned disadvantages of the traditional ADF.

It is a main object of the present invention to provide a releasing device to separate the rollers within the exit roller set for removing the jammed paper sheet from the exit roller set.

It is another object of the present invention to provide a releasing device to separate the rollers within the relay roller set for removing the jammed paper sheet from the relay roller set.

An ADF with a feeding roller used to carry a paper sheet to a reading position is provided in the present invention. The ADF comprises a feeding path, a paper cartridge, an exit roller set, and a first lever. The feeding path is arranged in the ADF for guiding the paper sheet reaching the reading position and leaving the reading position. The paper cartridge has a fixed front edge aligned with an inlet of the feeding path. The exit roller set is located by the feeding path and at a downstream position with respect to the reading position. The exit roller set includes two exit rollers leaning against each other for carrying the paper sheet leaving the ADF. The first lever is connected between the paper cartridge and one of the exit rollers. As the paper sheet is jammed at the exit roller set, the paper cartridge may be raised to drive the first lever to separate the two exit rollers for removing the jammed paper sheet.

In addition, the ADF in accordance with the present invention further has a cover, a relay roller set, and a second lever. The cover is assembled above the feeding path and shielding the feeding path. The relay roller set is located by the feeding path and at an upstream position with respect to the reading position. The relay roller set further includes two relay rollers leaning against each other for feeding the paper sheet to the reading position. The second lever is connected with the upper cover and one of the relay rollers. As the paper sheet is jammed at the relay roller set, the upper cover may be raised to drive the second lever to separate the two relay rollers for removing the jammed paper sheet.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1A:
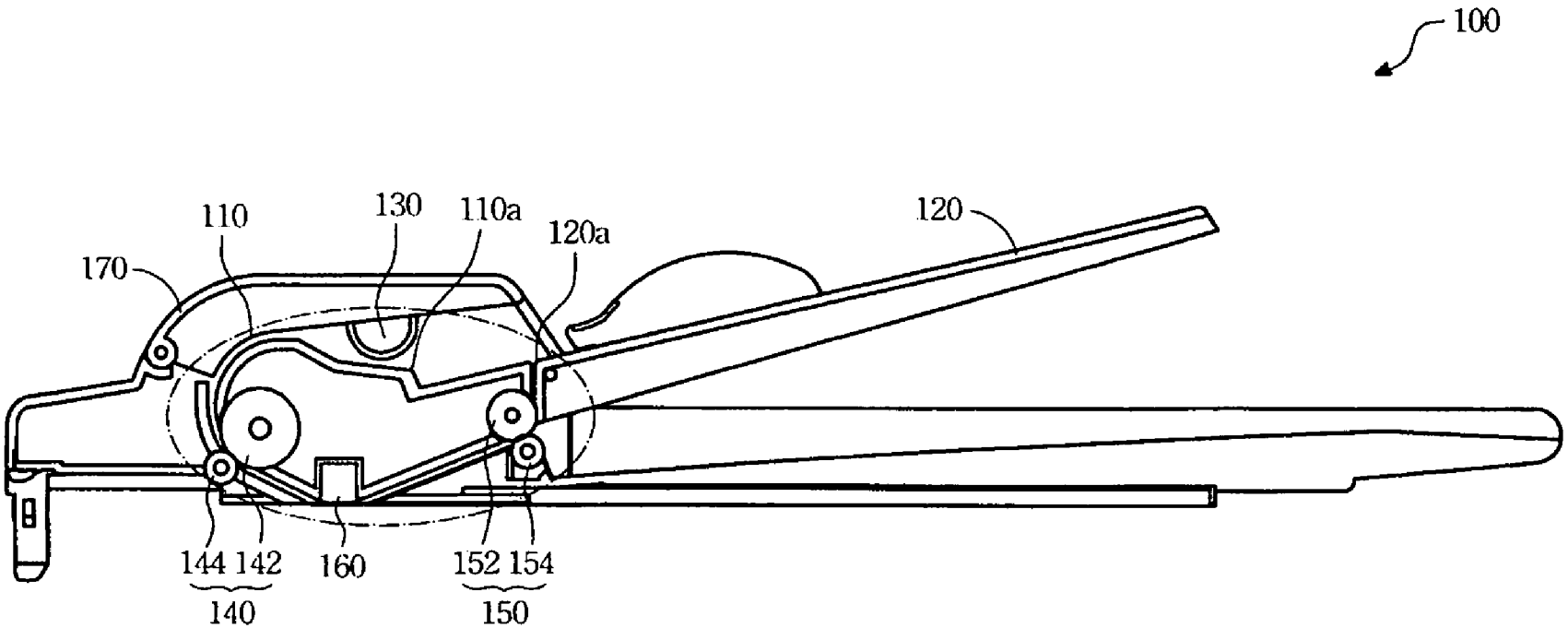
FIG. 1A (Prior Art)
FIG. 1A is a schematic cross section view of a traditional automatic document feeder (ADF)
Figure 1B:
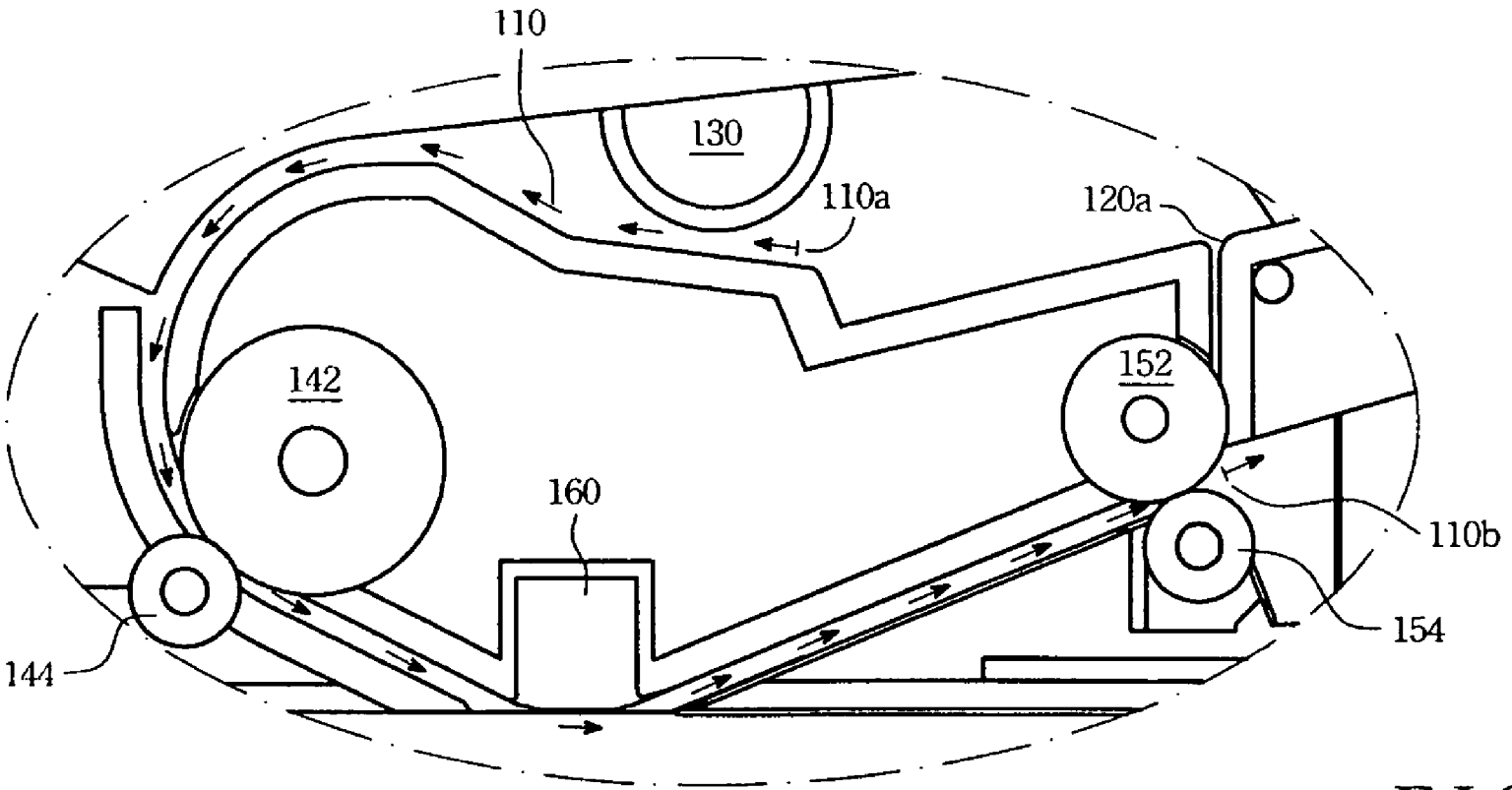
FIG. 1B (Prior Art)
FIG. 1B is an enlarged cross section view depicting the feeding path of the traditional ADF shown in FIG. 1A.
Figure 2:
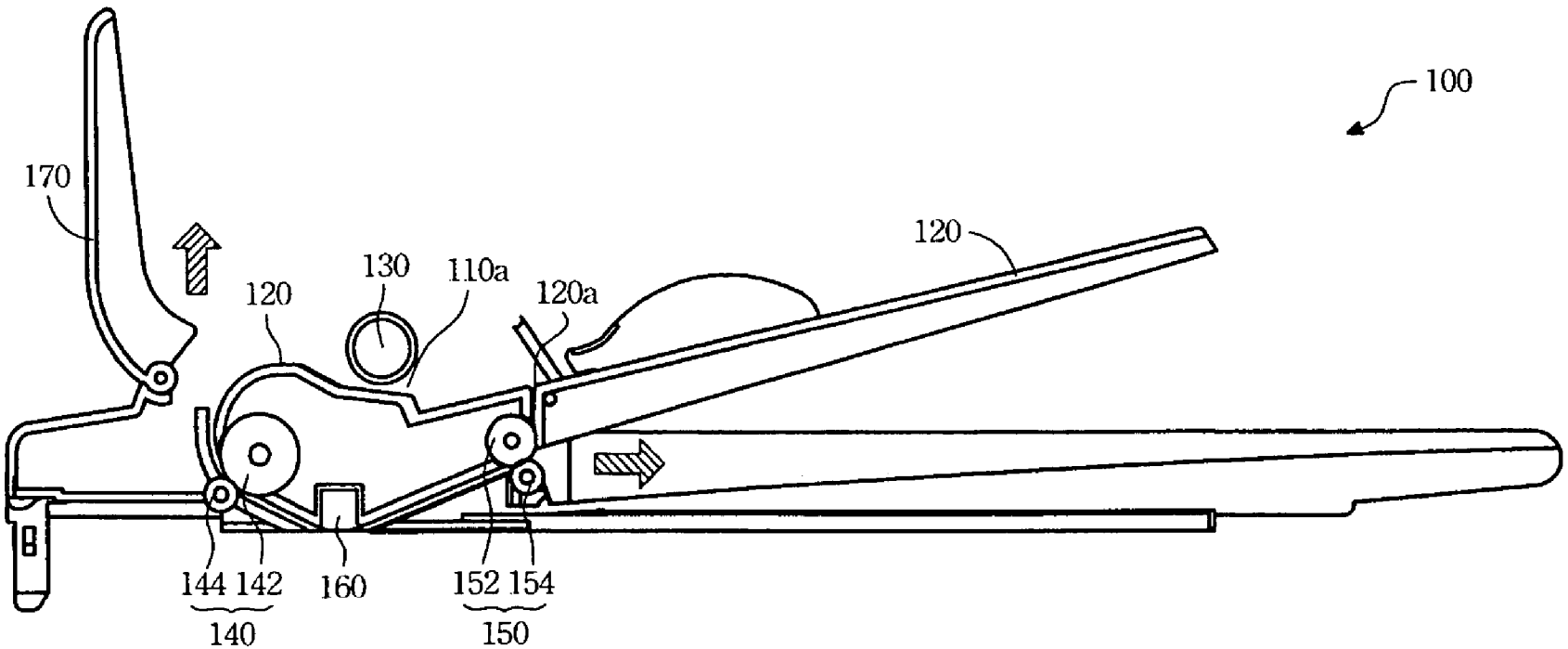
FIG. 2 (Prior Art)
FIG. 2 is a schematic view depicting a typical method for removing the jammed paper sheet in the traditional ADF shown in FIG. 1A.
Figure 3A:
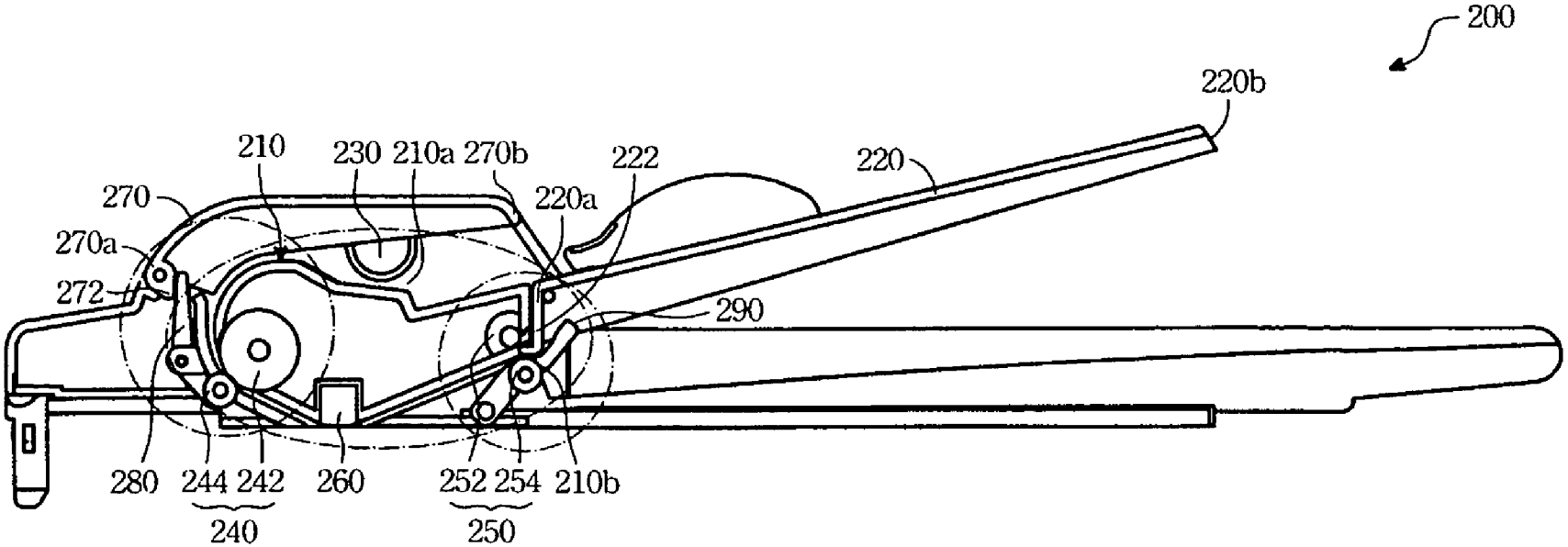
FIG. 3A is a schematic view of a preferred embodiment of an ADF in accordance with the present invention.
Figure 3B:
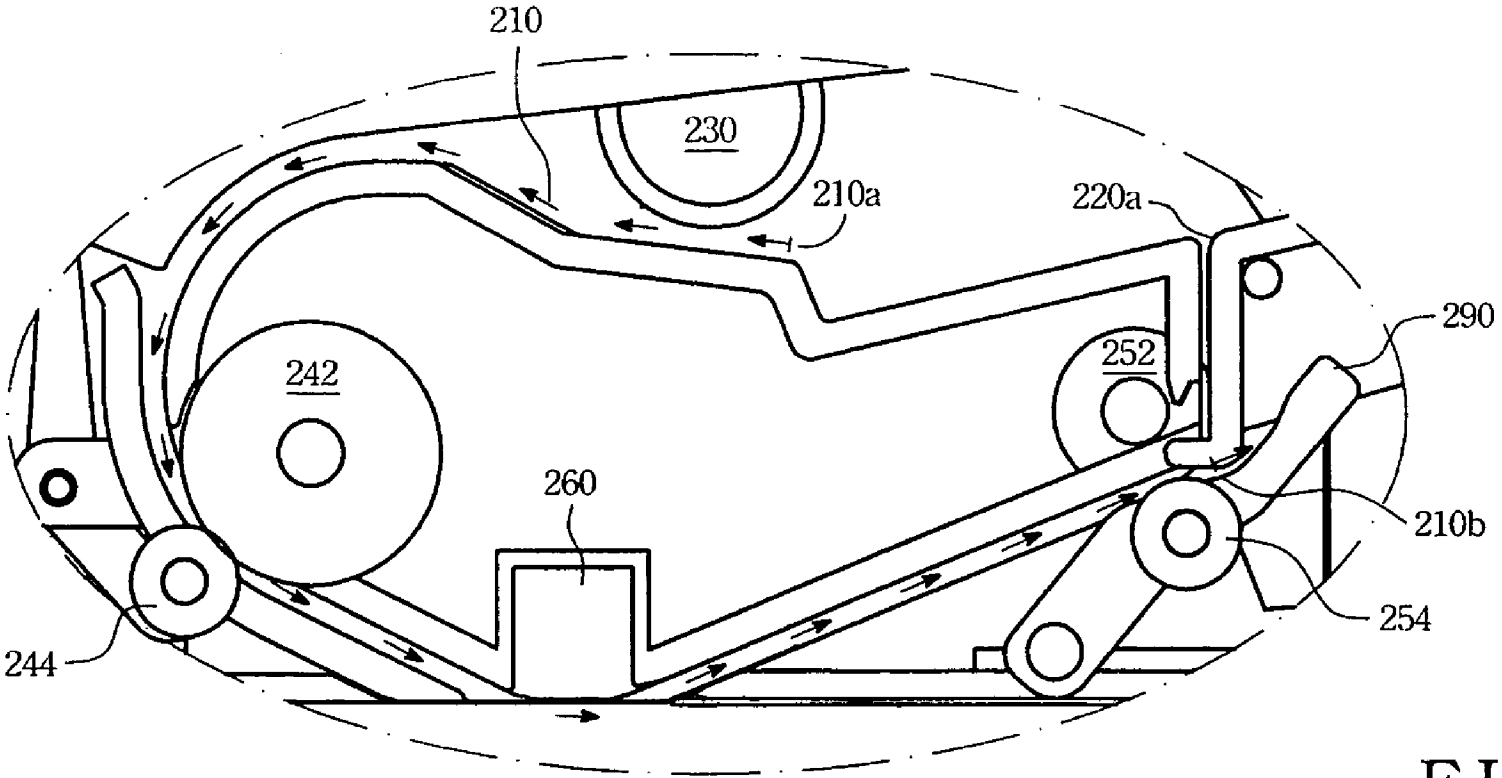
FIG. 3B is an enlarged view depicting the feeding path of the ADF shown in FIG. 3A.

FIG. 3A shows a cross section view of a preferred embodiment of an automatic document feeder (ADF) 200 with a feeding path 210 arranged therein. FIG. 3B is an enlarged view of the portion shown in FIG. 3A encircled by central line and indicating the feeding path 210 by the arrow. As shown, the feeding path 210 for guiding a paper sheet to a reading position 260 for scanning, copying, or the like has a C-shaped curve. An inlet 210*a* of the feeding path 210 is located above the outlet 210*b* of the feeding path 210. The reading position 260 is located in a rear section of the feeding path 210.

A paper cartridge 220 is provided on the right-hand side of the feeding path 210 shown in FIG. 3A for supporting the paper sheet to be fed into the feeding path 210. A front edge 220*a* of the paper cartridge 220 is fixed to be positioned close to the inlet 210*a* of the feeding path 210 so as to have the paper cartridge 220 aligning to the feeding path 210. In addition, a downward protrusion 222 is formed on the paper cartridge 220 and adjacent to the front edge 220*a*.

A cover 270 is provided above the feeding path 210 for shielding the paper sheet passing through the feeding path 210 from dust. An edge 270*a* of the cover 270 is fixed for allowing the cover been raised to rotate round the edge 270*a*. In addition, a downward protrusion 272 is formed on the cover and adjacent to the fixed edge 270*a*.

Downstream the feeding path 210, the paper sheet passes through a feeding roller 230, a relay roller set 240, and a exit roller set 250 in a serial. The feeding roller 230 is located by the inlet 210*a* of the feeding path 210 so as to feed the paper sheet to the feeding path 210 and pass the pass sheet to the reading position 260 to be scanned, copied, or the like. The relay roller set 240 is located about a middle section of the feeding path 210, where is also an upstream position with respect to the reading position 260. The relay roller set 240 includes a first relay roller 242 and a second relay roller 244 located on opposite sides of the feeding path 210 respectively and leaning against each other for clipping and feeding the paper sheet to the reading position 260. The exit roller set 250 is located in a rear section of the feeding path 210, where is also a downstream position with respect to the reading position 260. The exit roller set 250 includes a first exit roller 252 and a second exit roller 254 located on opposite sides by the outlet 210*b* of the feeding path 210 and leaning against each other for carrying the paper sheets leaving the feeding path 210.

In addition, by properly adjusting the angular speeds of the rollers in the relay roller set 240 and the exit roller set 250, a stretch force is formed to flatten the paper sheet to facilitate the scanning or copying in the reading position 260.

Figure 3D:
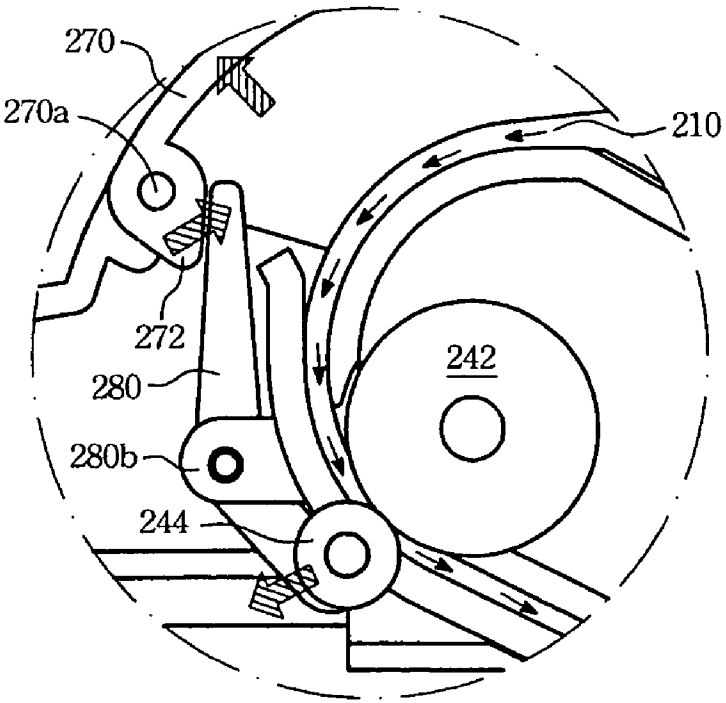
FIG. 3D is an enlarged view depicting the relay roller set of the ADF shown in FIG. 3A.
Figure 3C:
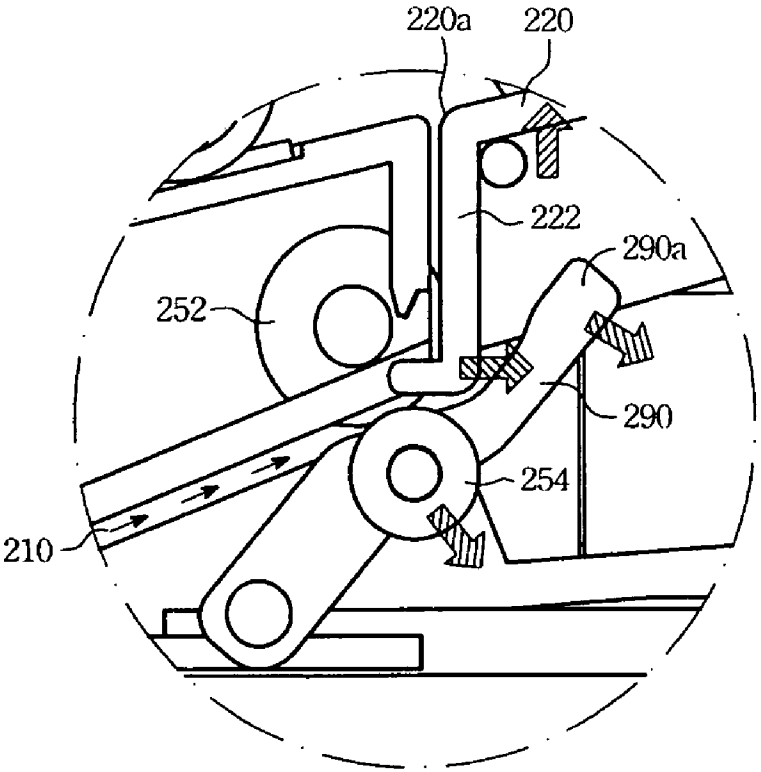
FIG. 3C is an enlarged view depicting the exit roller set of the ADF shown in FIG. 3A.

FIG. 3C is an enlarged view depicting the exit roller set 250 of the ADF 200 shown in FIG. 3A. As shown, a rotatable arm 290 is provided between the paper cartridge 220 and the exit roller set 250, and also connects with the second exit roller 254. In addition, a movable end 290*a* of the rotatable arm 290 leans against the protrusion 222 of the paper cartridge 220.

Figure 4A:
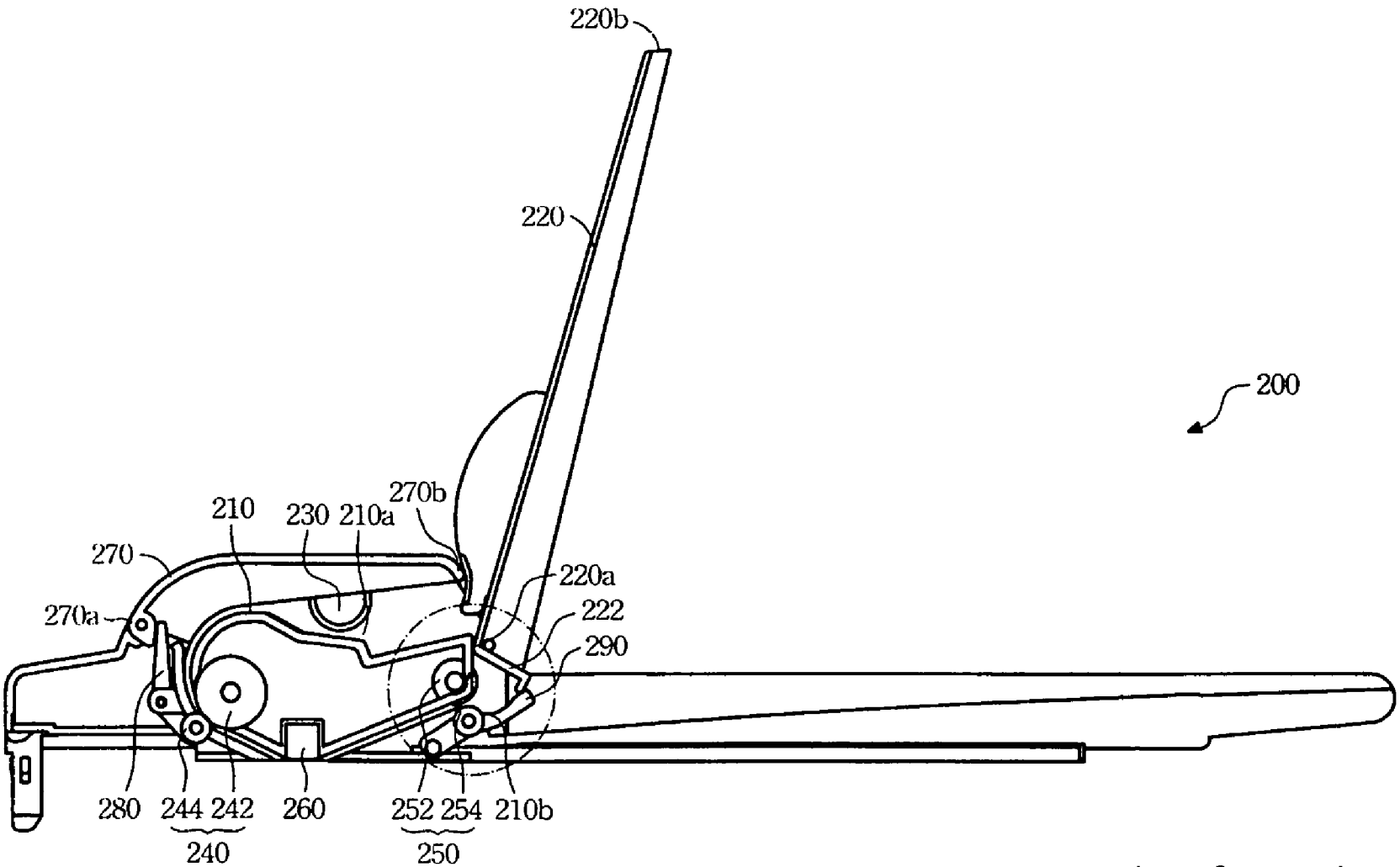
FIG. 4A is a schematic view depicting a method for removing the jammed paper sheet clipped in the exit roller set of the ADF shown in FIG. 3A.

As the paper sheet is jammed in the exit roller set 250, a rear end 220*b* of the paper cartridge 200 is lifted as shown in FIG. 4A for removing the jammed paper sheet. Also referring to FIG. 4B, which shows the enlarged view of the exit roller set 250 of FIG. 4A, as the paper cartridge 220 is lifted, the protrusion 222 adjacent to the front edge 220*a* of the paper cartridge 200 moves downward and rightward to drive the rotatable arm 290. The rotation of the rotatable arm 290 further pushes the second exit roller 254 separating from the first exit roller 252 to release the clipped paper sheet.

It is noted that at least one of the two exit rollers 252 and 254 must be active for carrying the paper sheets, and the active roller must connect to a driving device such as a driving motor. As a fixed driving device is preferred in the present invention, the above mention active roller had better be the fixed first exit roller 252, and the second exit roller 254 can be an idle roller for simplifying the mechanical design.

Figure 4B:
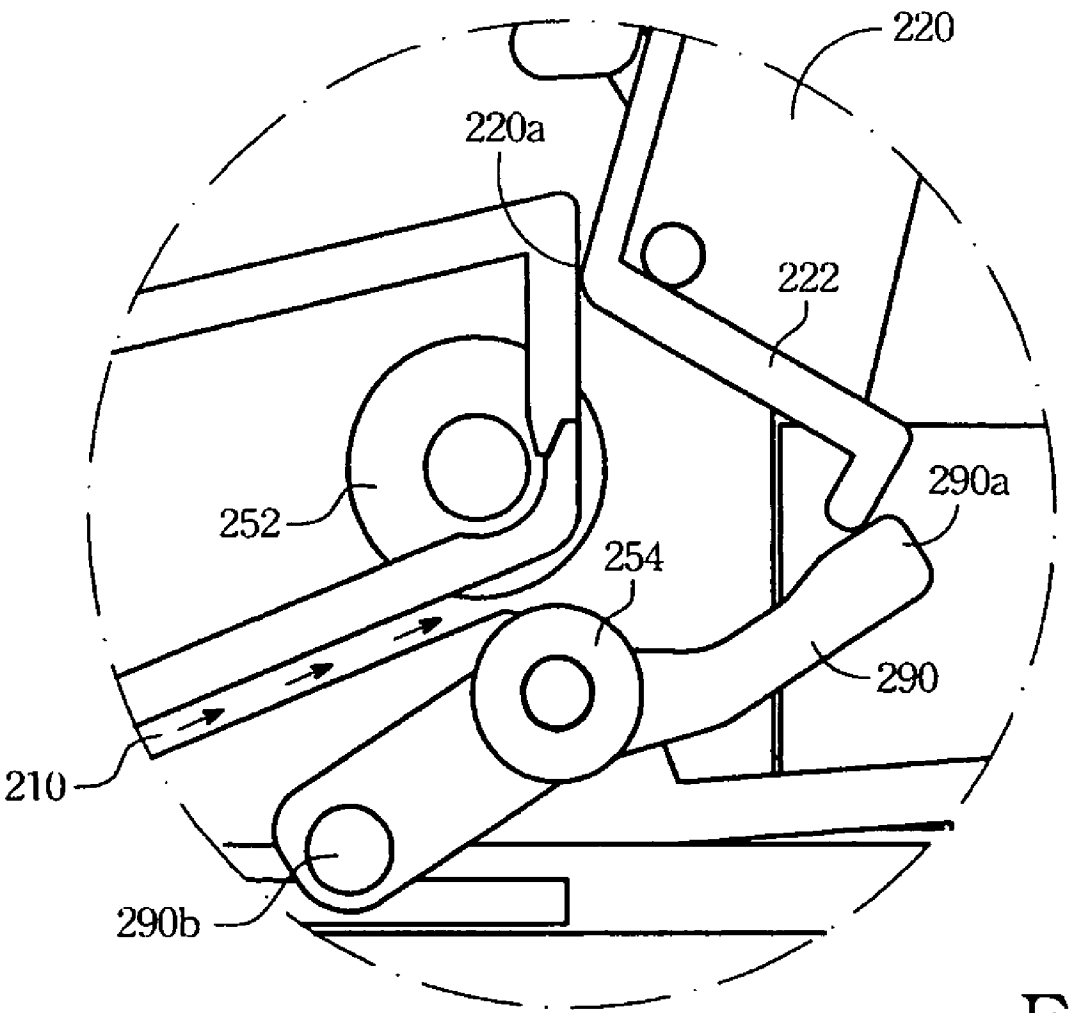
FIG. 4B is an enlarge view showing the exit roller set of FIG. 4A.

Referring to FIG. 4B, after the jammed paper sheet is removed, the paper cartridge 220, the rotatable arm 290, and the second exit roller 254 must be drawn back to their original positions. Therefore, in a preferred embodiment, a twisted spring (not shown) may be used to assembled in a fulcrum 290*b* of the rotatable arm 290 to generate a torque driving the rotatable arm 290 back to its original position and meanwhile push the second exit roller 254 leaning against the first exit roller 252. Alternatively, in another preferred embodiment, a compressive spring (not shown) may be used to assembled underneath the second exit roller 254 to offer an elastic force pushing the second exit roller 254 back to lean against the first exit roller 252 and meanwhile drive the rotary arm 290 back to its original position.

FIG. 3D is an enlarged view depicting the relay roller set 240 of the ADF 200 shown in FIG. 3A. As shown, a lever 280 is provided between the cover 270 and the relay roller set 240. In addition, one end of the lever 280 leans against the protrusion 272 of the upper cover 270 and another end of the lever 280 is connected with the second relay roller 244.

Figure 5A:
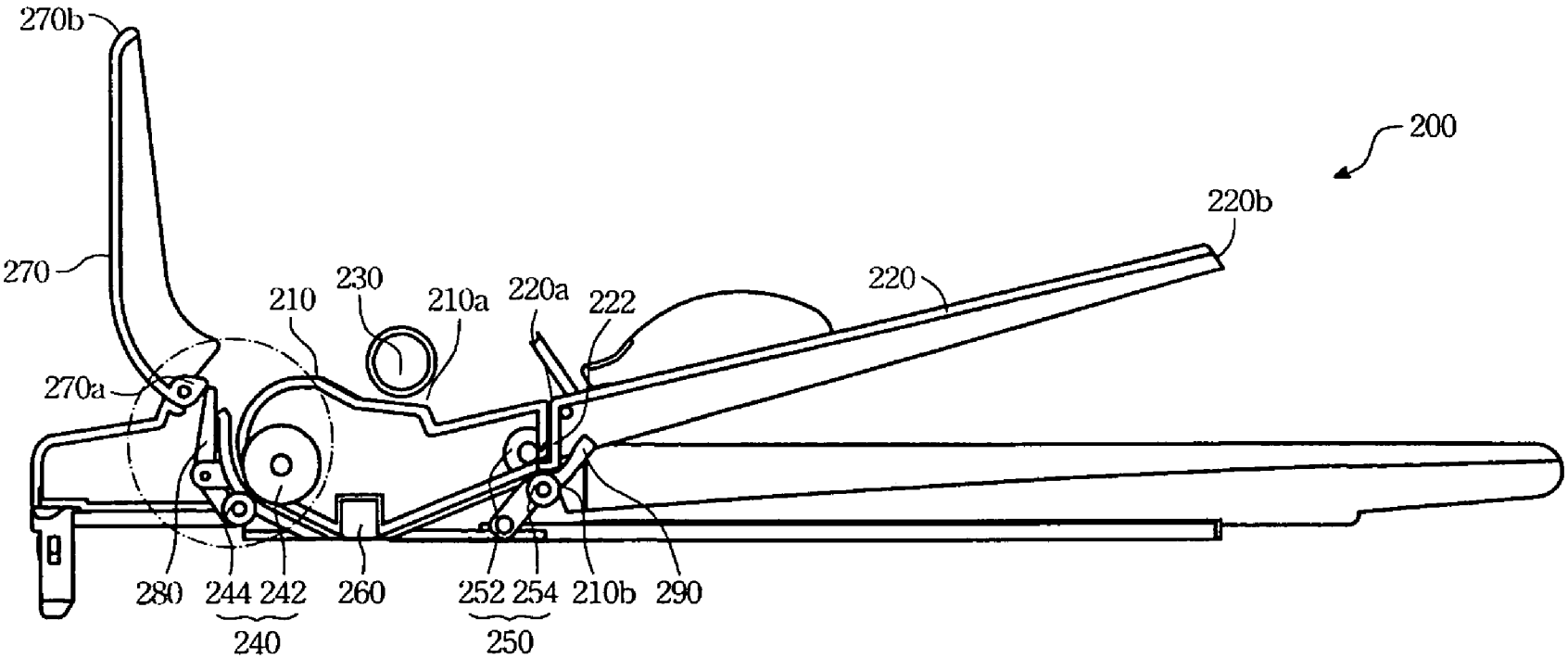
FIG. 5A is a schematic view depicting a method for removing the jammed paper sheet clipped in the relay roller set of the ADF shown in FIG. 3A.

As the paper sheet is jammed in the relay roller set 240, a movable end 270*b* of the cover 270 must be raised as shown in FIG. 5A for removing the jammed paper sheet. Also referring to FIG. 5B, which shows an enlarged view depicting the relay roller set 240 shown in FIG. 5A, as the movable end 270*b* is lifted, the protrusion 272 of the cover 270 drives the lever 280 to rotate. Simultaneously, the rotation of the lever 280 further pushes the second relay roller 244 separating from the first relay roller 242 to release the jammed paper sheet.

It is noted that at least one of the two exit rollers 242 and 244 must be active for carrying the paper sheets, and the active roller must connect to a driving device such as a driving motor. As a fixed driving device is preferred in the present invention, the above mentioned active roller had better be the fixed first exit roller 242, and the second exit roller 244 can be an idle roller for simplifying the mechanical design.

Figure 5B:
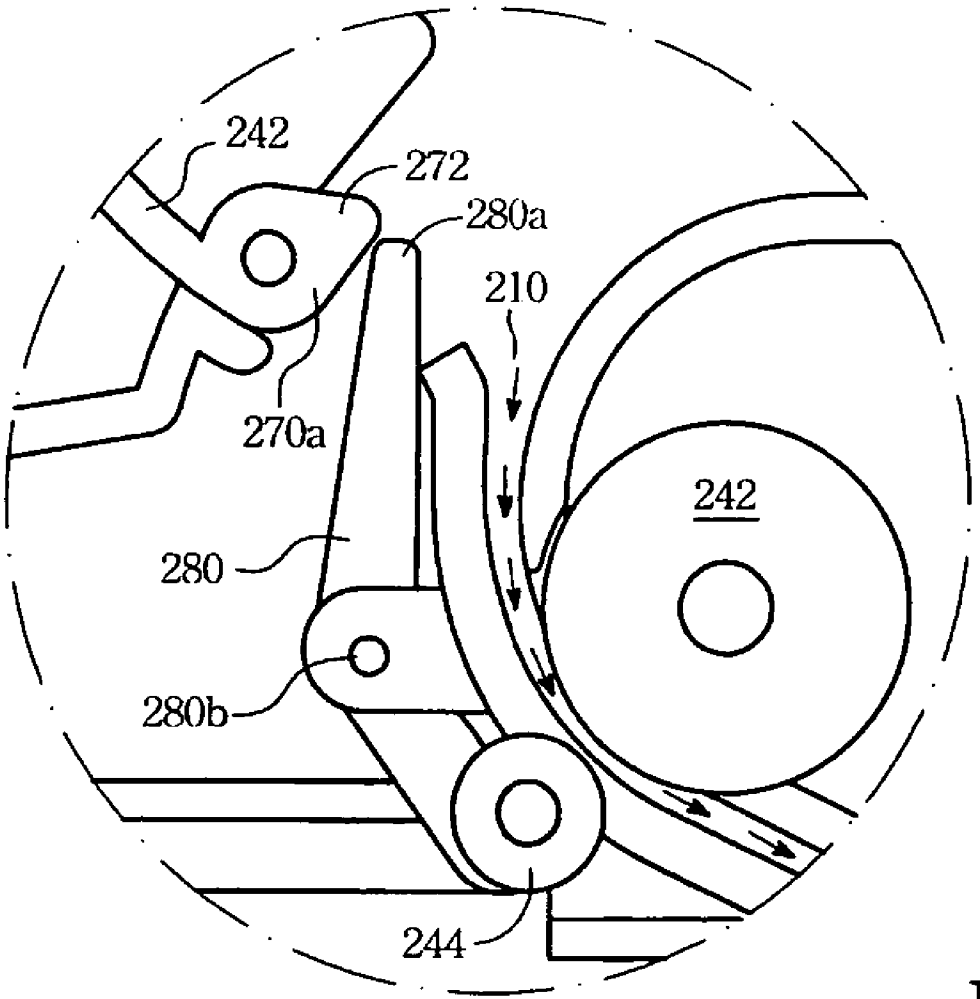
FIG. 5B is an enlarge view showing the relay roller set of FIG. 5A.

Referring to FIG. 5B, after the jammed paper sheet is removed, the upper cover 270, the lever 280, and the second relay roller 244 must be drawn back to their original positions. Therefore, in a preferred embodiment, a twisted spring (not shown) may be used to assemble in a fulcrum 280*b* of the lever 280 to generate a torque to drive the lever 280 back to its original position and meanwhile push the second relay roller 244 leaning against the first relay roller 242. Alternatively, in another preferred embodiment, a compressive spring (not shown) may be used to connected with the second relay roller 244 to offer an elastic force to push the second relay roller 244 leaning against the first relay roller 242 and meanwhile drive the lever 280 and the cover 270 back to their original positions.

By contrast with the traditional ADF 100, the ADF 200 in accordance with the present invention has the following advantages.

Firstly, the ADF 200 in accordance with the present invention has two releasing devices corresponding to the relay roller set 240 and the exit roller set 250 respectively by using lever principle to separate the rollers in the relay roller set 240 and the exit roller set 250. Therefore, the drawbacks of the traditional ADF 100, which may lead to a damage to the paper sheets and the ADF, can be resolved.

Secondly, even a paper sheet with highly important is severely jammed in the relay roller set 240 or the exit roller set 250 in accordance with the present invention, the jammed paper sheet can be easily removed by using the above-mentioned releasing devices. Therefore, the maintenance cost as well as the time cost of sending the ADF back to the dealer can be significantly reduced.

Thirdly, the releasing devices of the ADF 200 in accordance with the present invention utilize the existing upper cover 270 and paper cartridge 220 for applying force to separate the rollers in the relay roller set 240 and the exit roller set 250. Therefore, few additional elements are demanded in the ADF 200 in accordance with the present invention.

Fourth, it is understood that before trying to remove the jammed paper sheet form the relay roller set 240, the upper cover 270 is often lifted for inspecting the jammed situation, and before trying to remove the jammed paper sheet form the exit roller set 250, the paper cartridge 220 is often lifted for inspecting the jammed situation from the outlet 210*b*. Because the ADF 200 in accordance with the present invention uses the cover 270 and the paper cartridge 22 for applying force to separate the rollers in the relay roller set 240 and the exit roller set 250, the usage of the releasing devices within the ADF in accordance with the present invention is rather convenient.

While the preferred embodiments of the present invention have been set forth for the purpose of disclosure, modifications of the disclosed embodiments of the present invention as well as other embodiments thereof may occur to those skilled in the art. Accordingly, the appended claims are intended to cover all embodiments which do not depart from the spirit and scope of the present invention.

We claim:

1. An automatic document feeder (ADF) with a feeding roller used to carry a paper sheet to a reading position comprising:

a feeding path in the ADF for guiding the paper sheet reaching and leaving the reading position;

a paper cartridge having a fixed front edge aligned with an inlet of the feeding path; an exit roller set located by the feeding path and at a downstream position with respect to the reading position having two exit rollers leaning against each other for carrying the paper sheet leaving the ADF, and one of the exit rollers being an active roller and the other being an idle roller; and a first lever connected between the paper cartridge and the idle roller of the exit rollers;

when the paper sheet is jammed at the exit roller set, the paper cartridge may be raised to drive the first lever to separate the two exit rollers for removing the jammed paper sheet.

2. The automatic document feeder according to claim 1, further comprising:

a cover shielding the feeding path;

a relay roller set located by the feeding path and at an upstream position with respect to the reading position including two relay rollers leaning against each other for clipping and feeding the paper sheet to the reading position; and a second lever connected with the upper cover and one of the relay rollers;

when the paper sheet is jammed at the relay roller set, the cover is raised to drive the second lever to separate the two relay rollers for removing the jammed paper sheet.

3. The automatic document feeder according to claim 2, wherein the relay roller connected with the second lever is an idle roller.

4. An automatic document feeder (ADF) having a feeding roller used to carry a paper sheet to a reading position comprising:

an C-shaped feeding path in the ADF for guiding the paper sheet reaching and leaving the reading position, which is located in a rear section of the C-shaped feeding path, and an inlet of the C-shaped feeding path is located above an outlet of the C-shaped feeding path;

a paper cartridge having a fixed front edge aligning with the inlet of the feeding path and a downward protrusion adjacent to the front edge;

an exit roller set having a first exit roller and a second exit roller leaning against each other and located in opposite sides of the feeding path respectively; and a rotatable arm, which is located between the paper cartridge and the exit roller set, connecting with the second exit roller and having a movable end leaning against the protrusion of the paper cartridge;

when the paper sheet is jammed at the exit roller set, the paper cartridge may be raised to drive the rotatable arm to separate the two exit rollers for removing the jammed paper sheet.

5. The automatic document feeder according to claim 4, wherein the first exit roller is an active roller, and the second exit roller is an idle roller.

6. The automatic document feeder according to claim 4, further comprises: a relay roller set located in a middle section of the feeding path including a first relay roller and a second relay roller leaning against each other the first relay roller and the second relay roller are located on the opposite sides of the feeding path for clipping and feeding the paper sheet into the reading position.

7. The automatic document feeder according to claim 6, further comprises: a cover shielding the feeding path including a fixed edge and a downward protrusion adjacent to the fixed edge.

8. The automatic document feeder according to claim 7, further comprises: a lever having two ends connected with the protrusion of the cover and the second relay roller, respectively, when the cover is raised, the protrusion of the cover drives the lever to rotate so as to have the second relay roller separated from the first relay roller for removing the paper sheet.

9. The automatic document feeder according to claim 8, wherein the second roller is an idle roller.

* * * * *